US008118687B1

(12) United States Patent
Galloway

(10) Patent No.: US 8,118,687 B1
(45) Date of Patent: Feb. 21, 2012

(54) DEVICE TO MEASURE THE MOTION OF A GOLF CLUB

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 12/793,915

(22) Filed: Jun. 4, 2010

Related U.S. Application Data

(60) Provisional application No. 61/186,733, filed on Jun. 12, 2009.

(51) Int. Cl.
*A63B 69/36* (2006.01)

(52) U.S. Cl. ..... 473/221; 473/225

(58) Field of Classification Search ..... 473/150, 473/151, 219, 221, 222, 223, 225, 226, 257
See application file for complete search history.

(56) References Cited

U.S. PATENT DOCUMENTS 5,257,084 A * 10/1993 Marsh ..... 356/28
5,692,966 A * 12/1997 Wash ..... 473/221
6,095,928 A * 8/2000 Goszyk ..... 473/222
6,224,493 B1 5/2001 Lee et al.
6,375,579 B1 * 4/2002 Hart ..... 473/131
6,402,634 B2 6/2002 Lee et al.
6,431,990 B1 8/2002 Manwaring
6,461,248 B1 * 10/2002 Gross ..... 473/220
6,638,175 B2 10/2003 Lee et al.
6,821,209 B2 11/2004 Manwaring et al.
7,163,468 B2 1/2007 Gibbs et al.
7,163,470 B2 1/2007 Galloway et al.
7,166,038 B2 1/2007 Williams et al.
7,214,143 B2 5/2007 Deshmukh
7,252,600 B2 8/2007 Murphy et al.
7,258,626 B2 8/2007 Gibbs et al.
7,258,631 B2 8/2007 Galloway et al.
7,273,419 B2 9/2007 Evans et al.
7,413,520 B1 8/2008 Hocknell et al.
7,892,102 B1 * 2/2011 Galloway ..... 473/225
2005/0202907 A1 * 9/2005 Otten et al. ..... 473/457
2008/0200274 A1 * 8/2008 Haag et al. ..... 473/222

* cited by examiner

*Primary Examiner* — Nini Legesse
(74) *Attorney, Agent, or Firm* — Michael A. Catania; Rebecca Hanovice; Sonia Lari

(57) ABSTRACT

A club shaft that can be installed in a club head permanently or can be installed in clubs with interchangeable shaft features is disclosed herein. The invention is a measurement system that enables the capturing of the speed and motion of the golfer's swing. The invention uses infrared reflectors positioned on a golf club and an array of infrared sensors.

2 Claims, 2 Drawing Sheets

DEVICE TO MEASURE THE MOTION OF A GOLF CLUB

CROSS REFERENCES TO RELATED APPLICATIONS

The Present Application claims priority to U.S. Provisional Patent Application No. 61/186,733, filed on Jun. 12, 2009.

STATEMENT REGARDING FEDERALLY SPONSORED RESEARCH OR DEVELOPMENT

Not Applicable

BACKGROUND OF THE INVENTION

1. Field of the Invention

The present invention relates to a swing analysis devices for golf clubs. More specifically, the present invention relates to a golf club swing analysis device that uses infrared reflectors.

2. Description of the Related Art

Golf clubs combine with the players swing to propel a ball toward a favored location and through a favored path. The orientation and speed of the club head at impact largely determines the ball path including carry distance and roll.

The prior art is lacking in a method and system to measure the motion of the club using infrared technology.

BRIEF SUMMARY OF THE INVENTION

The present invention is novel in that the observation of the relative motion does not depend on near visible light and uses a coherent pattern to capture the position of the club relative the ground antenna transmitter/receiver. This fixed device also includes a display, computing capability and recording device. This information, when processed, enables the display of the swing and uses data on the club head and ball to calculate the flight of the ball.

This invention is a club that uses infrared reflectors that can be attached to a golf club. The club is swung through an array of infrared sensors positioned on a surface, preferably in front of a golf ball, to capture the speed and motion of the golfer's swing. The system is designed to improve the accuracy of measurement of location as a function of time. The invention enables the accurate measurement and capture of the swing, produces a display of the impact and ball flight and thus improves the training and practice results for the golfer.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
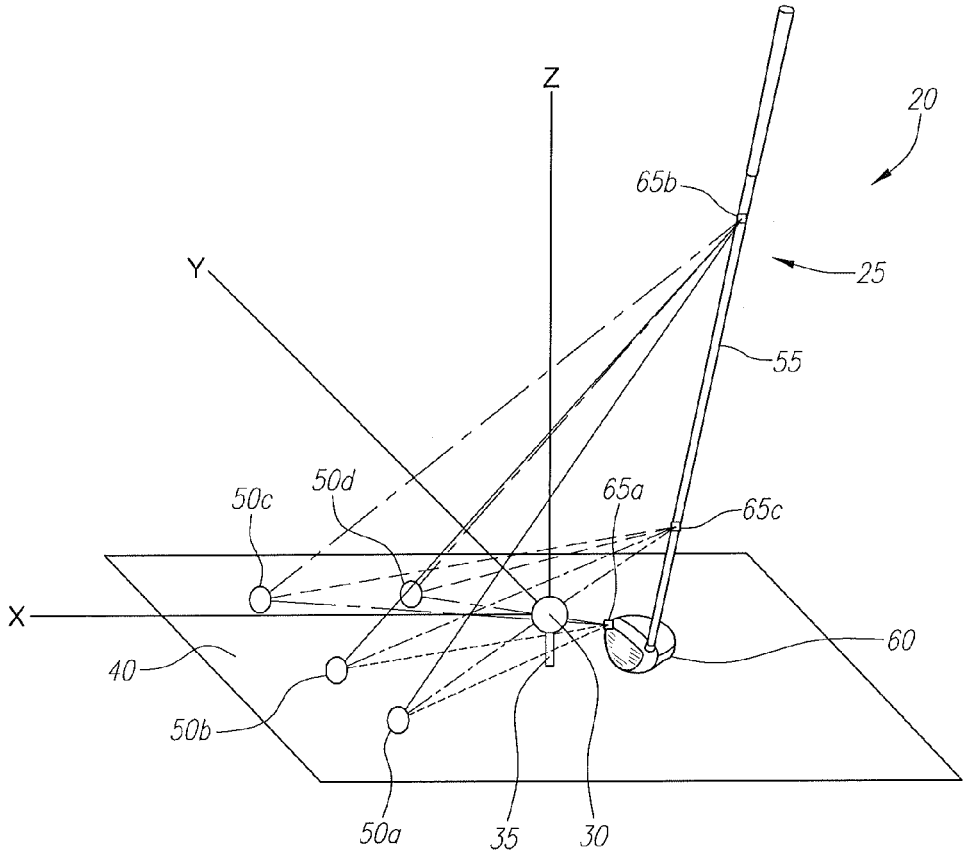
FIG. 1 is a perspective view of system for measuring the motion of a club through a infrared sensor field.
Figure 2:
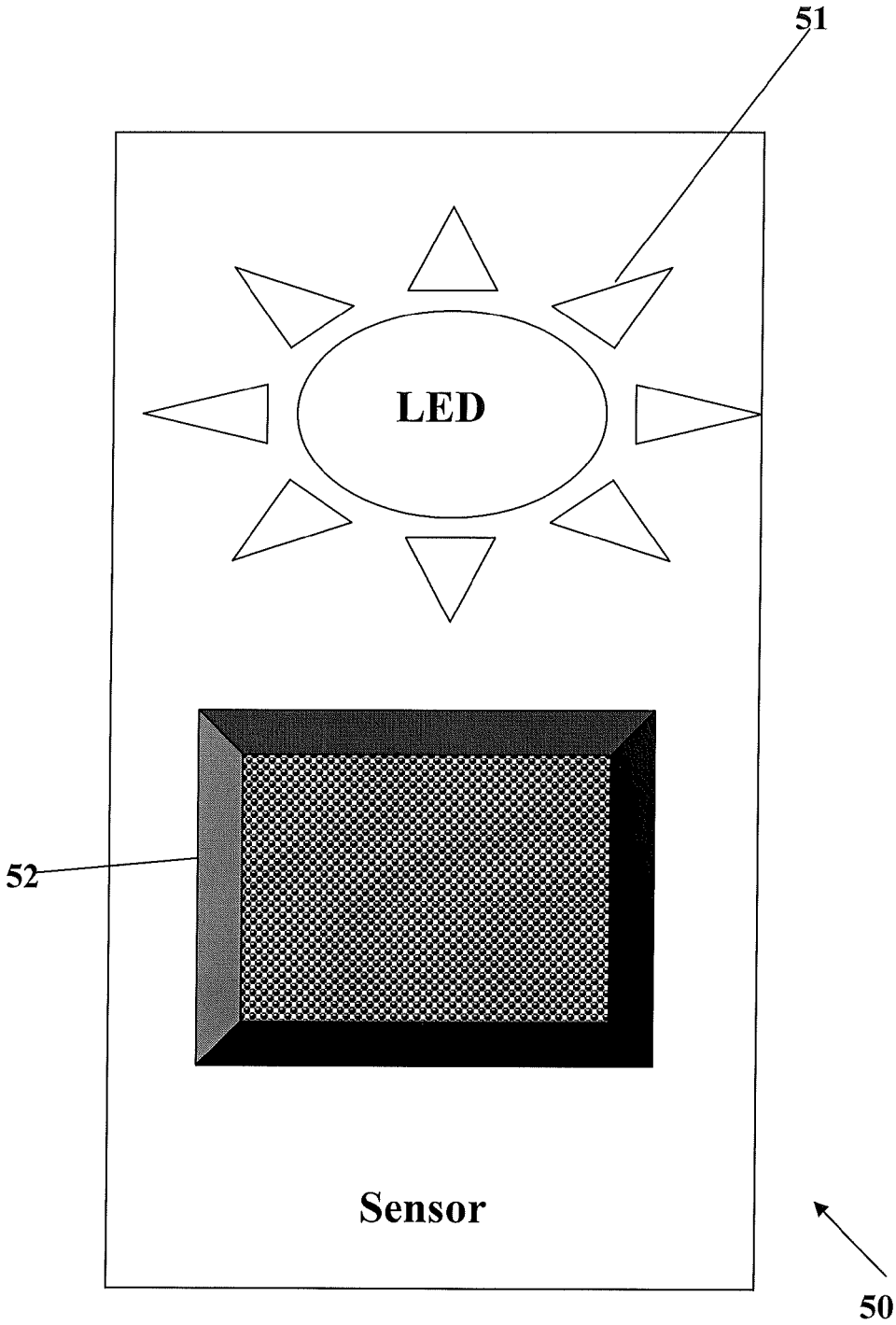
FIG. 2 is an isolated block diagram of an infrared sensor having a photodetector and a LED.

As shown in FIG. 1, a golf club bearing infrared reflectors is swung through an array of infrared sensors at a golf ball. A system 20 preferably includes a golf club 25, a golf ball 30, a tee 35, a mat 40 and infrared sensors 50*a*, 50*b*, 50*c* and 50*d*. As shown in FIG. 2, each sensor 50 comprises an LED (light emitting diode) 51 that generates infrared light and a photodetector 52 that detects reflected infrared light. The golf club 25 includes a shaft 55 and a golf club head 60 with a toe-side infrared reflector 65*a* and a lower shaft infrared reflector 65*b* and an upper shaft infrared reflector 65*c*.

The following patents disclose various golf clubs that may be used with the device of the present invention. Gibbs, et al., U.S. Pat. No. 7,163,468 is hereby incorporated by reference in its entirety. Galloway, et al., U.S. Pat. No. 7,163,470 is hereby incorporated by reference in its entirety. Williams, et al., U.S. Pat. No. 7,166,038 is hereby incorporated by reference in its entirety. Desmukh U.S. Pat. No. 7,214,143 is hereby incorporated by reference in its entirety. Murphy, et al., U.S. Pat. No. 7,252,600 is hereby incorporated by reference in its entirety. Gibbs, et al., U.S. Pat. No. 7,258,626 is hereby incorporated by reference in its entirety. Galloway, et al., U.S. Pat. No. 7,258,631 is hereby incorporated by reference in its entirety. Evans, et al., U.S. Pat. No. 7,273,419 is hereby incorporated by reference in its entirety. Hocknell, et al., U.S. Pat. No. 7,413,250 is hereby incorporated by reference in its entirety.

The measurements may be inputted into an impact code such as the rigid body code disclosed in U.S. Pat. No. 6,821,209, entitled Method for Predicting a Golfer's Ball Striking Performance, which is hereby incorporated by reference in its entirety.

The swing properties are preferably determined using an acquisition system such as disclosed in U.S. Pat. No. 6,431,990, entitled System and Method for Measuring a Golfer's Ball Striking Parameters, assigned to Callaway Golf Company, the assignee of the present application, and hereby incorporated by reference in its entirety. However, those skilled in the pertinent art will recognize that other acquisition systems may be used to determine the swing properties.

Other methods that are useful in obtaining a golfer's swing characteristics are disclosed in U.S. Pat. No. 6,638,175, for a Diagnostic Golf Club System, U.S. Pat. No. 6,402,634, for an Instrumented Golf Club System And Method Of Use, and U.S. Pat. No. 6,224,493, for an Instrumented Golf Club System And Method Of Use, all of which are assigned to Callaway Golf Company, the assignee of the present application, and all of which are hereby incorporated by reference in their entireties.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A system for measuring the motion of a golf club swung by a golfer, the system comprising:

a golf club comprising a shaft and a golf club head, the golf club having a plurality of infrared reflectors thereon;

a golf ball positioned on a tee extending upward from a mat;

a plurality of infrared sensors positioned to create a swing field for reception of a reflected signal from the plurality of infrared reflectors as the golf club is swung through the swing field, each of the plurality of infrared sensors generating infrared radiation;

wherein the plurality of infrared sensors is able to capture the speed and motion of the golf club as the golf club is swung through the swing field by a golfer; and—herein the plurality of infrared reflectors comprises a first infrared reflector on a toe-end position of the golf club head, a second infrared reflector on a lower portion of the shaft and a third infrared reflector on an upper portion of the shaft.

2. The system according to claim 1 wherein each of the plurality of infrared sensors comprises a LED that generates infrared radiation and a photodiode for receiving the reflected infrared radiation from the plurality of infrared reflectors.

* * * * *